US006443713B1

(12) United States Patent
Weiss et al.

(10) Patent No.: US 6,443,713 B1
(45) Date of Patent: Sep. 3, 2002

(54) DIAPHRAGM PUMP WITH SUPPORT RING

(75) Inventors: Paul J. Weiss, Elkhart Lake; Jeffrey J. Weiss, Sheboygen, both of WI (US)

(73) Assignee: Thomas Industries Inc., Sheboygan, WI (US)

( * ) Notice: Subject to any disclaimer, the term of this patent is extended or adjusted under 35 U.S.C. 154(b) by 37 days.

(21) Appl. No.: 09/691,697

(22) Filed: Oct. 18, 2000

(51) Int. Cl.[7] ..... F04B 17/00
(52) U.S. Cl. ..... 417/413.1; 925/100; 925/140
(58) Field of Search ..... 417/454, 413.1, 417/571; 92/100, 140

(56) References Cited

U.S. PATENT DOCUMENTS

| | | | | | |
|---|---|---|---|---|---|
| 1,992,491 | A | | 2/1935 | Lindsay | |
| 2,463,766 | A | | 3/1949 | Hadley | 230/170 |
| 2,942,550 | A | | 6/1960 | Carter | |
| 3,074,346 | A | | 1/1963 | Jackson | 103/53 |
| 3,610,273 | A | | 10/1971 | Russell | |
| 4,396,363 | A | * | 8/1983 | Sakamaki et al. | 417/439 |
| 4,469,473 | A | * | 9/1984 | Brown | 417/571 |
| 4,507,062 | A | | 3/1985 | Wally | 417/413 |
| 4,842,498 | A | | 6/1989 | Bramstedt | |
| 5,022,832 | A | * | 6/1991 | Lauterbach et al. | 417/571 |
| 5,454,397 | A | * | 10/1995 | Miszczak | 137/513 |
| 5,791,882 | A | | 8/1998 | Stucker et al. | 417/269 |
| 6,126,410 | A | * | 10/2000 | Kung et al. | 417/312 |
| 6,227,520 | B1 | * | 5/2001 | Huber, Jr. | 251/61.5 |
| 6,315,534 | B1 | * | 11/2001 | Chou | 417/550 |

FOREIGN PATENT DOCUMENTS

| | | |
|---|---|---|
| DE | 38 01 515 | 7/1988 |
| FR | 2 176 289 | 10/1973 |
| JP | 59 051179 | 3/1984 |

* cited by examiner

*Primary Examiner*—Charles G. Freay
*Assistant Examiner*—William H. Rodriguez
(74) *Attorney, Agent, or Firm*—Quarles & Brady LLP

(57) ABSTRACT

Disclosed herein is a wobble diaphragm pump having a housing with an open neck. A wobble piston can be passed through the open neck and fit onto the pump motor shaft. A separate support ring is fastened to the housing to close the open neck and provide a circumferential support surface for the diaphragm. The support ring also includes locking projections that mate with recessed features in the housing and a valve head to properly align and unite these components during assembly.

12 Claims, 3 Drawing Sheets

DIAPHRAGM PUMP WITH SUPPORT RING

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention pertains to pumps and in particular to wobble diaphragm pumps.

Wobble diaphragm pumps, such as those used in air compressors, typically have one or more pistons mounted on a rotatable shaft that is eccentrically driven by a suitable motor to reciprocate each piston in a compression chamber. One type of diaphragm pump has a compliant seal member or diaphragm fixed to the housing at its periphery and attached to the flange of the piston. As the piston reciprocates the diaphragm flexes in and out. Using an appropriate valve assembly, having intake and exhaust valves (such as flapper valves) which alternately open and close during the suction and pump strokes, respectively, the reciprocating motion moves air into and out of the compression chamber.

One problem with ordinary wobble diaphragm pumps is that they can be difficult to assemble. Specifically, the shell of the electric motor unit is often press-fit onto the housing to which the rotor is journaled. Thus, the pistons must be mounted on the shaft by inserting the piston connecting rod down through a hole in the bottom of the compression chamber and angling it as needed to fit a bore in the connecting rod over the shaft. A bearing and an eccentric element must also be mounted onto the shaft and within the connecting rod. This makes it difficult to properly position the connecting rod on the shaft. Failure to properly mount the piston can cause misalignment leading to pump start-up problems, such as motor stall, diaphragm "slap", higher than normal amp draw and shortened operating life.

For conventional piston pumps without diaphragms, piston assembly is made easier by using a housing having an open neck. This allows the assembler to insert the shaft into the housing from the end of the housing and slide the connecting rod through the open neck and onto the shaft until it is seated at the appropriate position on the shaft. Once properly mounted, the open neck can be closed by an end cap fastened to the housing.

While this is suitable for conventional piston pumps, the diaphragm in wobble diaphragm pumps must be held down along its entire circumference to form a seal and create proper pressure differentials. As such, an open necked cylinder would ordinarily leave the diaphragm unsupported at the gap in the neck, and therefore, could not be used in a such a pump.

Accordingly, there is a need for a wobble diaphragm pump that allows for simpler and more accurate assembly.

SUMMARY OF THE INVENTION

The present invention solves the problems of the prior art by providing a diaphragm pump with a housing with an open-neck and a separate support ring that closes the open neck and supports the diaphragm about its entire circumference.

In particular, the present invention provides a diaphragm pump having a wobble piston eccentrically mounted to a rotatable shaft at one end and having a compliant sealing member attached at an opposite end. The pump also includes a housing and a support ring. The housing defines a crankcase extending axially beyond the shaft to an open access end and a neck extending perpendicularly to the axis of the shaft. The neck has an open throat which extends to the access end of the crankcase. The open throat allows the piston to be moved axially with respect to the shaft through the throat and onto the shaft. The support ring is mounted to the housing over the throat so as to span the throat and provide a circumferential support surface to which is mounted the circumference of the sealing member.

In a preferred form, the housing and support ring have complimentary locking features for aligning the support ring to the housing. Additionally, the pump includes a valve head mounted to the support ring opposite the sealing member. The support ring and valve head also have complimentary locking features for aligning the valve head to the support ring. The support ring has a stop-gap section that fits within the throat of the housing neck. The stop-gap section is of increased dimension relative to the rest of the support ring and has a convex bottom surface that matches the curvature of the end of the housing. This is provided so that cooling air flow through the housing cannot escape too easily through the throat. The housing also preferably includes a raised wall surrounding a portion of the support ring circumference.

The present invention also provides a method of assembling the diaphragm pump described above. Specifically, the pump is assembled by supporting the shaft inside of the housing crankcase and inserting the piston axially with respect to the shaft through the open throat onto the shaft so that the piston is substantially centered in the neck of the housing. The support ring is mounted on to the housing over the neck so as to span the throat. The sealing member is supported from below about its circumference by the support ring and captured between the support ring and the valve head assembly.

Thus, the present invention provides a diaphragm pump that can be accurately assembled in a simple, cost effective manner. This is accomplished by using an open-neck housing which allows the piston to be slid through the crankcase onto the motor shaft in the proper position. The support ring fills the gap of the throat and provides a circumferential support surface for the sealing member. The accurate piston positioning afforded prevents the occurrence of the aforementioned problems of difficult assembly.

The foregoing and other objects and advantages of the invention will appear from the following description. In this description reference is made to the accompanying drawings which form a part hereof and in which there is shown by way of illustration a preferred embodiment of the invention. Such embodiment does not necessarily represent the full scope of the invention, however, and reference must be made therefore to the claims for interpreting the scope of the invention.

DETAILED DESCRIPTION OF THE PREFERRED EMBODIMENT

Figure 1:
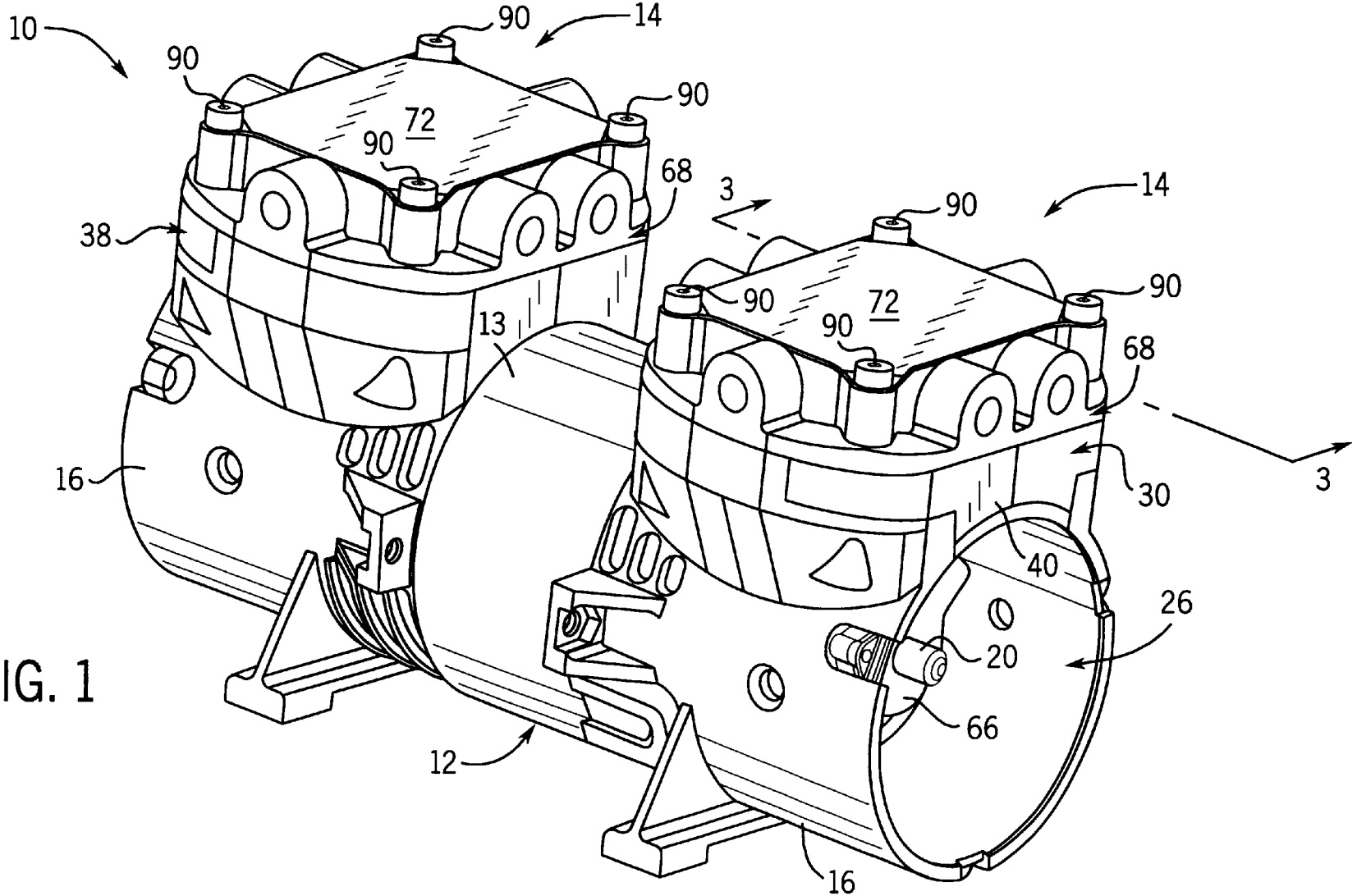
FIG. 1 is a perspective view of a dual-cylinder air compressor having two identical open-neck housings, one at each end, and separate support rings which close the gap of the open neck, the housing being shown without end caps over the access ends of the housings.

The present invention provides a diaphragm pump preferably used to provide forced air movement in air compressors of various sizes and capacities, however, the present invention could be used for other pumping applications and media. Referring to FIG. 1, a dual-cylinder air compressor 10 includes a motor 12, such as an AC electric motor, driving a pair of identical diaphragm pump units 14. It should be noted that the air compressor could be a single-cylinder compressor in which case an AC or DC motor could be used.

Figure 2:
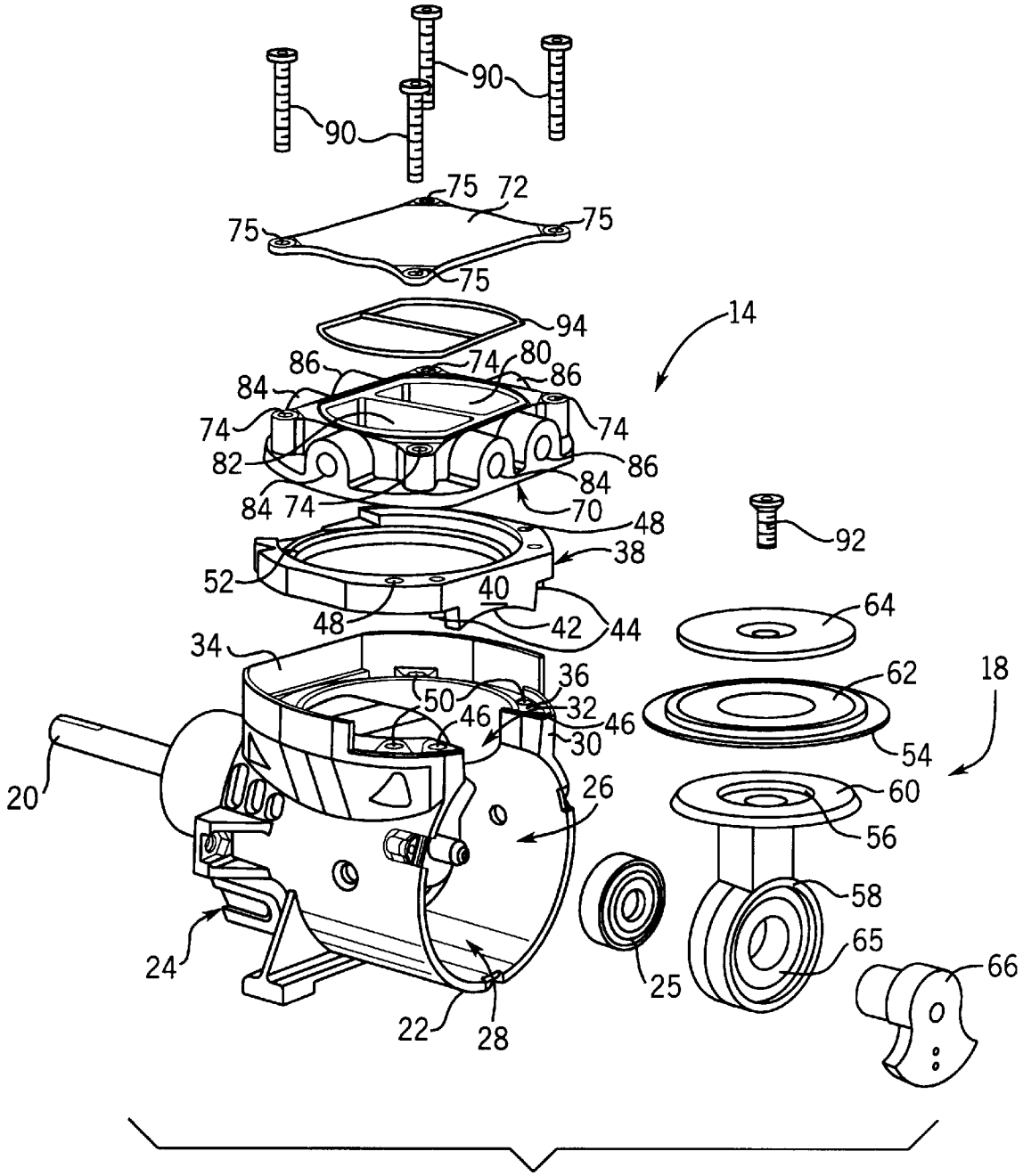
FIG. 2 is an exploded view of one end of the pump of FIG. 1.

Referring to FIGS. 1 and 2, each pump unit 14 includes a housing 16 containing a wobble piston 18 mounted to a shaft 20 which is rotated by the motor 12. Although the compressor 10 of FIG. 1 includes two pump units 14, for simplicity, only one of the pump units 14 will be described in detail.

Figure 3:
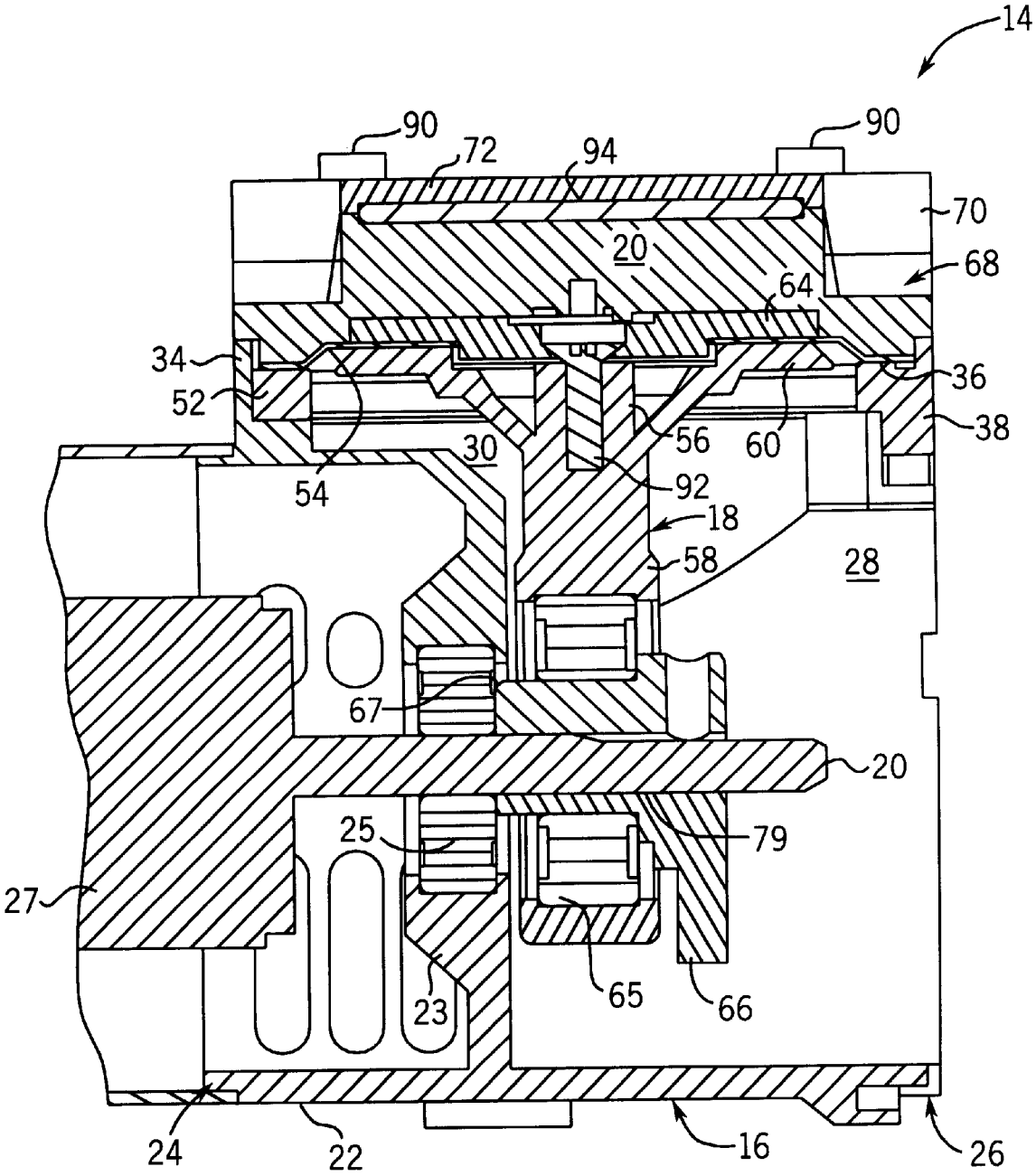
FIG. 3 is a cross-sectional view taken along line 3—3 of FIG. 1.

Referring to FIG. 2, each housing 16 has a motor end 24 and an open access end 26 covered by an end cap (not shown) suitably mounted to the housing 16. The housing 16 defines a generally cylindrical crankcase 28 concentric with the shaft 20 and separated from the motor end 24 by a partition 23 having an opening for receiving a bearing 25 through which the shaft 20 is disposed so that it is journaled to the housing 16 (as shown in FIG. 3). Preferably, the motor rotor 27 is fixed to the shaft 20 and the stator shell 13 is press-fit onto the motor end 24 of the housing 16.

The housing 16 also defines a generally cylindrical neck 30 extending upwardly perpendicular to the crankcase 28 between the ends 24 and 26. The neck 30 has an axially open throat 32 in common with the access end 26 of the housing 16. The neck 30 has a raised wall 34 and a flat ledge 36 around much of its outer circumference other than at the open throat 32. The ledge 36 provides a flat surface for supporting a diaphragm support ring 38, which fits within the raised wall 34.

The diaphragm support ring 38 has a stop-gap 40 of increased dimension that extends downwardly and is sized to fit closely within the throat 32 of the neck 30. The stop-gap 40 has a convex lower surface 42 of substantially the same radius as the chamber 28 so that when the diaphragm support ring 38 is mounted to the housing 16, there is a generally circular opening at the access end 26 so that a substantially circular end cap can be use to close the access end 26. A fan (not shown) may be mounted on the end of the shaft 20 adjacent the access end 26 and ventilation slots formed in the end cap for drawing cooling air into the housing 16. Closing off substantially all of the throat 32 prevents an excessive amount of cooling air from escaping out through it.

The diaphragm support ring 38 has a pair of bosses 44 projecting downwardly on each side of the stop-gap 40 that fit within recesses 46 in the housing 16 for aligning the diaphragm support ring 38 with the neck 30 and holding it in place prior to fastening. The diaphragm support ring 38 also includes bores 48 aligned with threaded recesses 50 in the housing 16 for securing the diaphragm support ring 38 to the housing 16 via suitable fasteners 90 extending down through the plate 72, head 70 and ring 38 (shown in FIG. 3).

The diaphragm support ring 38 has a top surface defining a circular ledge 52 for supporting an annular elastomeric diaphragm sealing member 54 about is entire circumference. The sealing member 54 is attached to a connecting rod 58 of the wobble piston 18. The connecting rod 58 has a circular flange 60 that fits within an inverted recess 62 which is formed in the sealing member 54. A backing plate 64 at the top surface of the inverted recess 62 is fastened to the connecting rod 58 via a suitable fastener 92 disposed through its center, which is threaded into a central boss 56 of the connecting rod 58, thereby securing the sealing member 54 to the connecting rod 58. The connecting rod 58 has an insert-molded bearing 65 opposite the flange 60 for receiving an eccentric element 66 that mounts onto the shaft 20 by a suitable means, such as a set screw connection. The eccentric element 66 has an axial bore 79 that is eccentric to its outer diameter so that the piston 18 reciprocates and wobbles within the neck 30 when the shaft 20 rotates. The eccentric element 66 also has an axially-projecting nib 67 (see FIG. 3) sized to contact the shaft bearing 23 so as to properly position the piston 18. This nib 67 has a small contact surface which rides on the inner race of the shaft bearing 25 to provide a positive stop for positioning the piston 18.

The outer circumference of the sealing member 54 is sandwiched between the diaphragm support ring ledge 52 and a valve head assembly 68. The valve head assembly 68 includes a valve head 70 having inlet and exhaust flapper valves (not shown) which move in response to air pressure, as known in the art, and which are in communication with inlet 80 and exhaust 82 chambers in the valve head 70. The inlet 80 and exhaust 82 chambers are each in fluid communication with three inlet 84 and exhaust 86 ports having fittings for attaching air lines (not shown). The valve chambers 80 and 82 of the valve head 70 are covered by a head plate 72 fastened to the valve head 70 by the threaded fasteners 90 that extend through bores 75, valve head bores 74 and diaphragm support ring bores 48 and threaded into threaded recesses 50 of the housing 16. Preferably, a suitable sealing ring or gasket 94 is disposed between the valve head 70 and the head plate 72 to prevent air leakage.

In a preferred form, the housing 16 and diaphragm support ring 38 are preferably made of aluminum alloy or a glass-filled nylon. The piston connecting rod 58 and backing plate 64 are preferably made of aluminum alloy or a polyphthalamide. The sealing member 54 is preferably a reinforced EPDM. The eccentric element 66 is a powdered metal and the valve head 70 and head plate 72 are aluminum.

As the motor 12 is operated the shaft 20 rotates and the eccentric element 66 causes the piston 18 to reciprocate back and forth with a wobble motion. The sealing member 54 and the reciprocating connecting rod 58 of the piston 18 draw air in through the inlet valve into the compression chamber 30 on the downstroke and force air out the exhaust valve to the valve head assembly 68 on the upstroke. The valves of the valve head 70 alternately open and close in response to the reciprocating piston 18 to allow outside air to be drawn through the inlet ports 84 and compressed air to be discharged through the exhaust ports 86, as known in the art.

Referring again to FIGS. 2 and 3, each pump 14 is assembled by journaling the shaft 20 to the housing 16 and press-fitting the shell onto the motor end 24 of the pump. Then, the piston 18 is assembled by fastening the backing plate 64 and the sealing member 54 to the connecting rod 58. The connecting rod 58 of the assembled piston is then inserted into the opening of the diaphragm support ring 38. The connecting rod 58 is then slid through the open throat 32 into the crankcase 28 onto the shaft 20 by inserting the shaft 20 through the bearing 65. The eccentric element 66 is then fit onto the shaft 20 and into the connecting rod bearing 65 in a light press fit. The eccentric element 66 is slid on the shaft 20 until the nib 67 contacts the shaft bearing 23 and can slide no more. In that position, the piston 18 is properly centered in the compression chamber 30. The connecting rod 58 is secured in place by fastening the eccentric element 66 to the shaft 20. The diaphragm support ring 38 is then mounted to the housing 16 over the neck 30 so as to close the open throat 32, aligning the bosses 44 with the housing recesses 46, so that the sealing member 54 is supported about its entire circumference by the diaphragm support ring 38. The circumference of the sealing member 54 is then sandwiched between the diaphragm support ring 38 and the valve head assembly 68 which is secured to the housing 16 by the threaded fasteners 90. The access end 26 is covered by an end cap (not shown) fastened to the housing 16.

Thus, the present invention provides easy to assemble diaphragm pumps that afford facile and accurate positioning. This reduces or eliminates the problems associated with assembly.

An illustrative embodiment of the invention has been described in detail for the purpose of disclosing a practical, operative structure whereby the invention may be practiced advantageously. The novel characteristics of the invention, however, may be incorporated in other structural forms without departing from the scope of the invention. Accordingly, in order to apprise the public of the full scope of the present invention, reference should be made to the following claims.

What is claimed is:

1. A diaphragm pump having a wobble piston eccentrically mounted to a rotatable shaft at one end and having a compliant sealing member attached at an opposite flange end of the piston, comprising:

a housing defining a crankcase extending axially beyond the shaft to an open access end and a neck extending perpendicularly to the shaft and having an open throat extending through the neck to the access end of the crankcase to allow the piston to be moved axially with respect to the shaft through the throat and onto the shaft; and a support ring mounted to the housing over the throat so as to span the throat and provide a circumferential support surface to which is mounted the circumference of the sealing member.

2. The apparatus of claim 1, further comprising an eccentric element mounting the piston to the shaft eccentrically.

3. The apparatus of claim 2, wherein the eccentric element includes an axially extending nib providing a positive stop for positioning the piston substantially concentric within the neck.

4. The apparatus of claim 1, wherein the housing and support ring have complimentary locking features for aligning the support ring to the housing.

5. The apparatus of claim 4, further comprising a valve head mounted to the support ring opposite the sealing member.

6. The apparatus of claim 5, wherein the support ring and valve head have complimentary locking features for aligning the valve head to the support ring.

7. The apparatus of claim 1, wherein the support ring has a stop-gap section that fits within the throat.

8. The apparatus of claim 7, wherein the stop-gap section is of increased dimension relative to the rest of the support ring.

9. The apparatus of claim 8, wherein the stop-gap section has a convex bottom surface.

10. The apparatus of claim 1, wherein the housing includes a raised wall surrounding a portion of the support ring.

11. A method of assembling a diaphragm pump having a housing with a neck and having an open throat in which is disposed a rotatable shaft eccentrically mounting a wobble piston with a compliant sealing member, the method comprising the steps of:

supporting the shaft inside the crankcase;

inserting the piston axially with respect to the shaft through the open throat onto the shaft so that the piston is substantially centered in the neck;

securing the piston to the shaft;

mounting a support ring onto the housing over the neck so as to span the throat; and fastening the sealing member to the support ring about its circumference.

12. The method of claim 11, further comprising the step of, prior to securing the piston to the shaft, inserting the piston into the support ring so that the sealing member can be supported by the support ring.

* * * * *